US006104007A

United States Patent [19]

Lerner

[11] Patent Number: 6,104,007

[45] Date of Patent: Aug. 15, 2000

[54] HEAT ALERT SAFETY DEVICE FOR STOVES AND RELATED APPLIANCES

[76] Inventor: William S. Lerner, 215 E. 68th St., Apt. 23A, New York, N.Y. 10021-5729

[21] Appl. No.: 09/016,575

[22] Filed: Jan. 30, 1998

[51] Int. Cl.[7] ..... H05B 3/68

[52] U.S. Cl. ..... 219/453; 219/464; 219/465; 126/39; 126/39 H

[58] Field of Search ..... 219/464, 448, 219/449, 450, 453, 463, 465, 466, 467, 468, 458, 445.1, 448.11, 460.1, 465.1, 468.1, 506; 126/39 H, 39 J, 218, 39 BA; 392/309; 116/216, 101; 374/161, 162

[56] References Cited

U.S. PATENT DOCUMENTS

| | | | |
|---|---|---|---|
| 2,870,316 | 1/1959 | Ferguson | 219/445.1 |
| 3,822,594 | 7/1974 | Parker | 73/356 |
| 4,983,810 | 1/1991 | Balderson | 219/445.1 |
| 5,750,959 | 5/1998 | Plumptre | 269/465 |

FOREIGN PATENT DOCUMENTS

| | | |
|---|---|---|
| 3835735 | 4/1990 | Germany . |

*Primary Examiner*—Teresa Wallberg
*Assistant Examiner*—Shawntina S. Fuqua
*Attorney, Agent, or Firm*—Steven Horowitz

[57] ABSTRACT

Liquid crystals compositions, i.e. cholesteric liquid crystals or various types of liquid crystal polymers designed to turn red at or above a specified temperature and remain red at or above that temperature and that are shaped in the outline of the word "HOT" (or for cooktop stoves of a ring surrounding the heating element that may be interrupted by such an outline) are embedded on the top surface of the heating element of stoves or on the window surface of wall ovens and toaster ovens so that they glow red and instantly alert anyone that the heat element of the stove or the window is too hot to touch. For use on electric stoves including small mobile electric stoves called hot plates, the device is an improved electric coil whose central recessed area contains liquid crystals. For use on smooth cooktop stoves, including small mobile cooktop stoves called warming trays, the liquid crystal display is embedded in a top surface of the smooth area of glass or metal that forms the heating element of the stove. For gas stoves, the liquid crystals are embedded in a disk mounted on a top surface of the central metal element of each heating element of the gas stove. For wall ovens and toaster ovens, the liquid crystals are embedded in the vertical window surface. In each embodiment, the liquid crystals stay red as long as the temperature they sense exceeds a certain degree Fahrenheit, such as 115 degrees Fahrenheit.

4 Claims, 5 Drawing Sheets

FIG.5
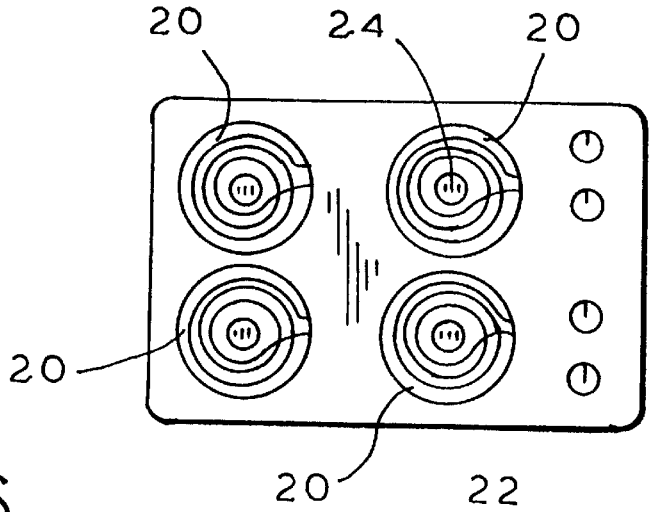
FIG.6
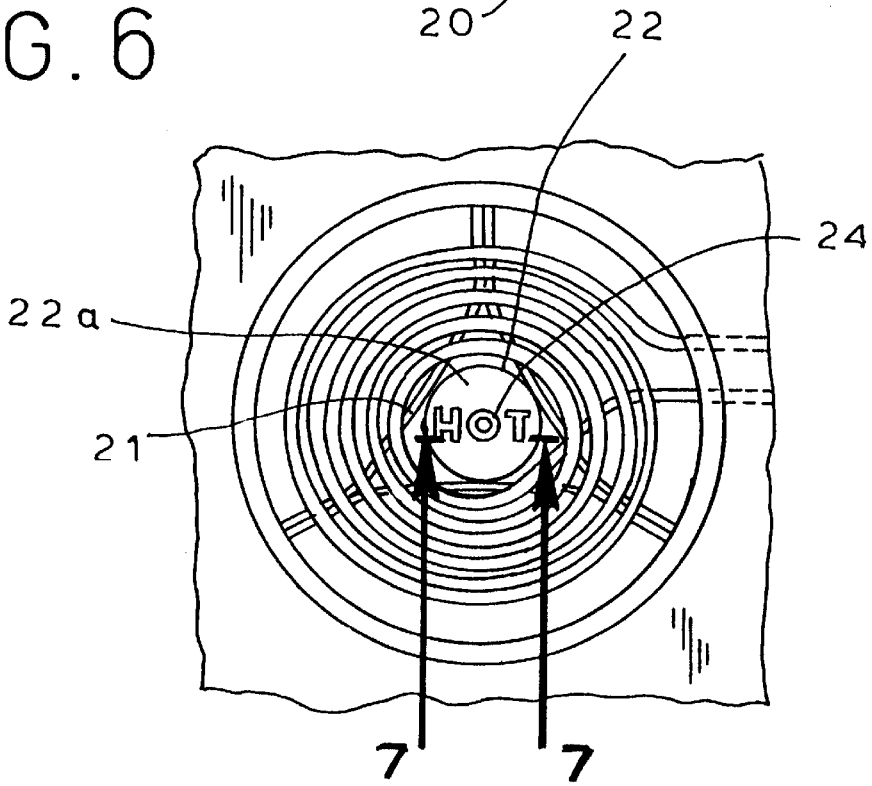
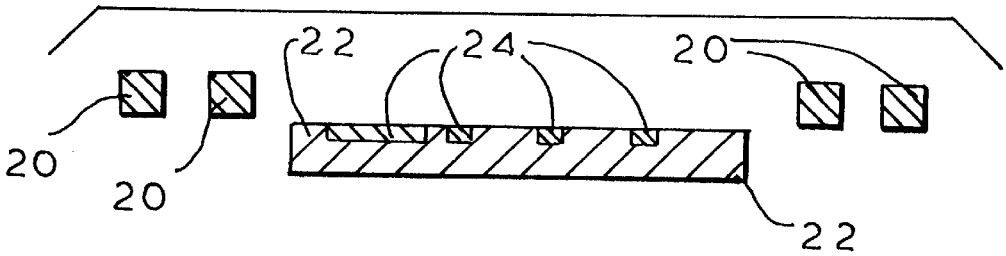
FIG.7

FIG. 9A
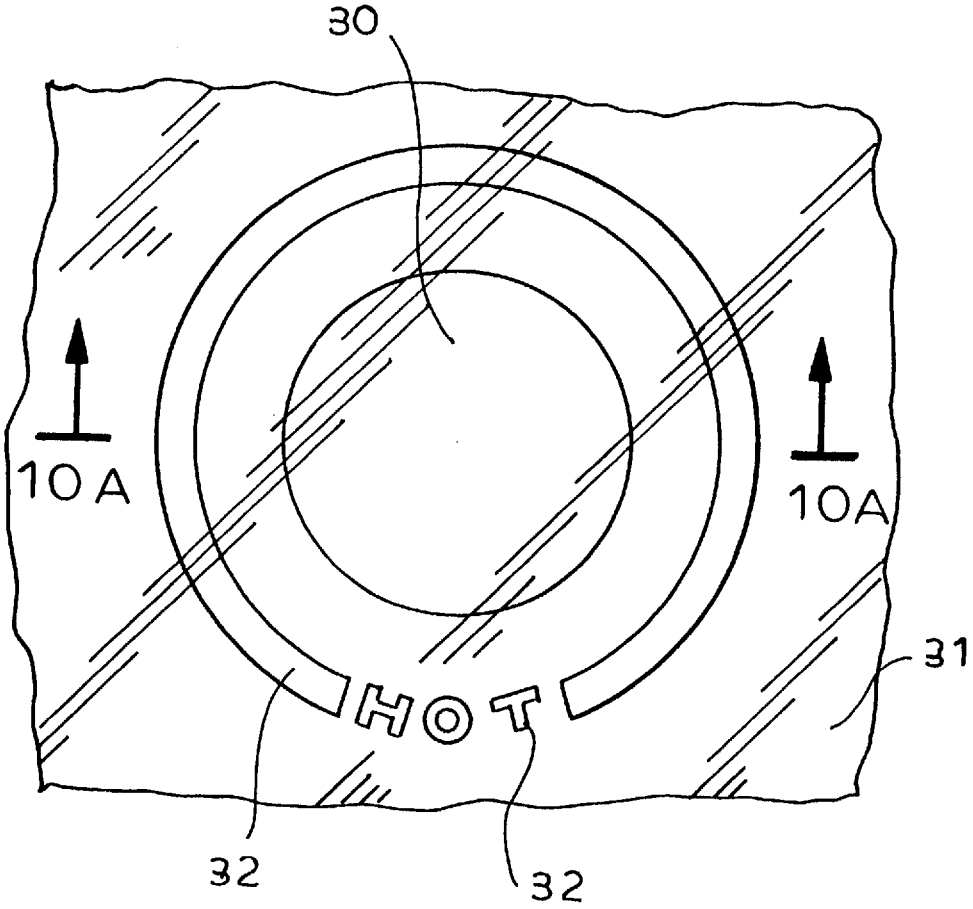
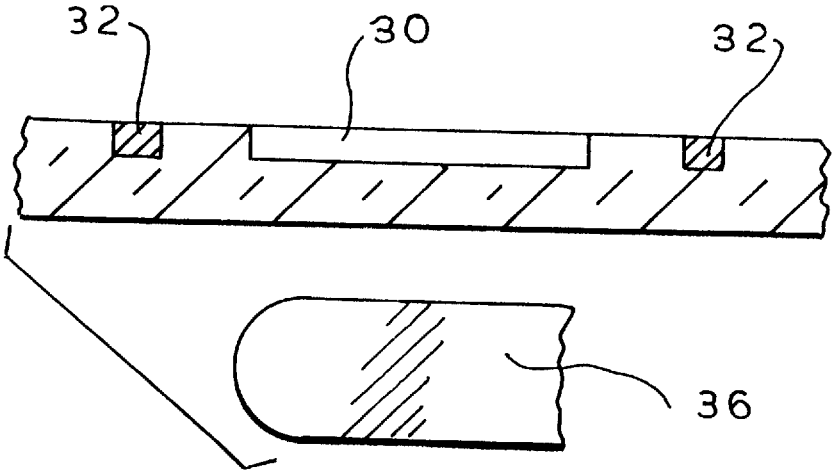
FIG. 10A

FIG. 11
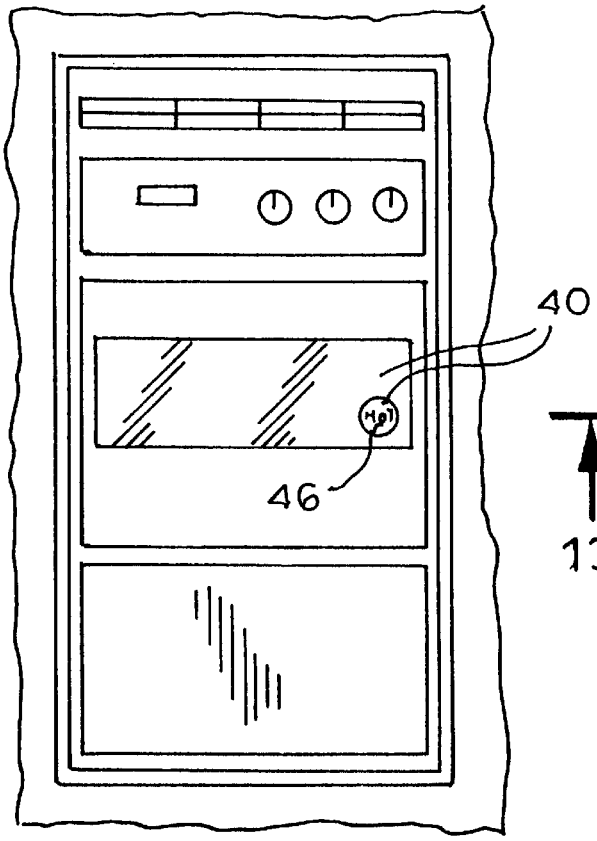
FIG. 12
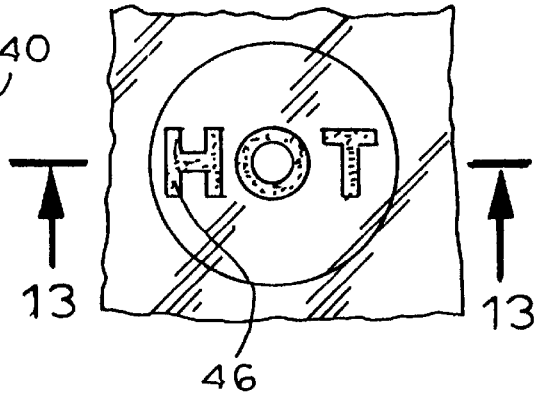
FIG. 13
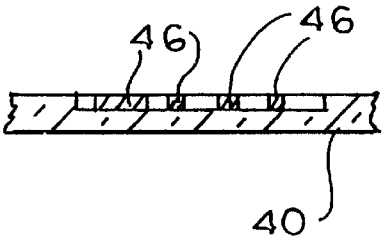
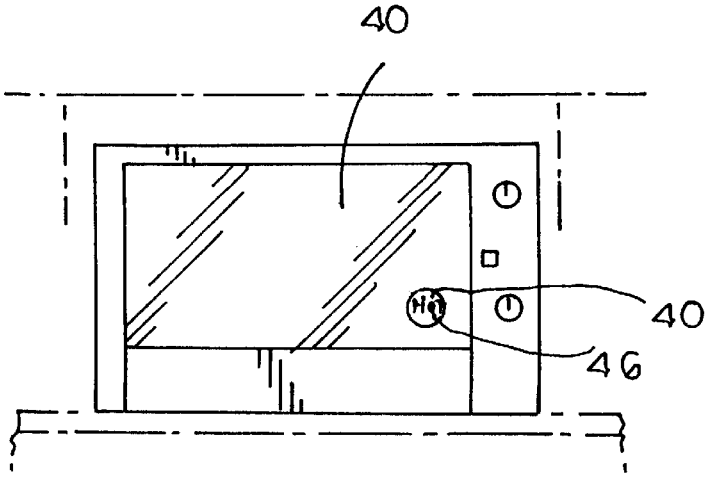
FIG. 14

HEAT ALERT SAFETY DEVICE FOR STOVES AND RELATED APPLIANCES

FIELD OF THE INVENTION

This invention relates to safety devices used in cooking and in particular to safety devices that alert someone that the surface of a stove is too hot to touch.

BACKGROUND OF THE INVENTION

Various kinds of stoves—electric, gas, smooth cooktop using glass or metal tops—and toaster ovens are well known to be used for heating food. In addition, "mobile stove-type appliances" such as hot plates and warming trays are well known to be used for heating food. Each of these kinds of stoves and "mobile stove-type appliances" present a safety problem since the heating elements of the stove are hot during the cooking process and remain hot well afterwards. During the cooking process, the safety problem caused by touching the heating element is mitigated somewhat by visual inspection of the stove. With a gas, electric or smooth top stove, for example, the presence of a pot or other utensil on top of the stove might alert someone to the fact that the stove appears to be in use for cooking and therefore too hot to touch. Even the presence of a pot or other utensil is not a reliable clue, however, since people tend to leave tea kettles on their stove perpetually. When the cooking process has ended, however, it is generally impossible to detect that the heating elements of the stove remains hot and would burn the skin of anyone who touched them. There is no visual or other clue that the stove is hot.

To some degree, adults have developed an inherent caution when approaching stoves because of their experience and knowledge in dealing with such safety problems. This inherent caution, however, does not obviate the need for a device that warns the adult when touching the stove would be dangerous. Moreover, children, and particularly young children, usually have not developed such a watchfulness and there has long been a need for a device that can prevent burn accidents to children who may inadvertently touch a stove that is hot, especially when the stove remains hot well after the cooking process has ended.

Furthermore, the reduction in the size of modern kitchens has led the occupants of modern apartments to make use of the stove as an extension of the counter top adjacent the stove as a resting places for large items that have been carried into the kitchen area. An example of such items is heavy bags of groceries brought into the kitchen. There is an urge to set the bags down on the nearest flat surfaces, which may be the top of a stove adjacent a counter top. This is particularly true for those stoves that are smooth on top, such as smooth cooktops. In general, the top surfaces of modern kitchen stoves are increasingly flat, especially the top surfaces of smooth cooktops. These factors have only increased the danger to adults when the top surfaces of stoves are used as a resting place for packages, such as groceries brought into the kitchen.

Smooth cooktop stoves presently are also dangerous if touched on their top surface when they are still hot, even after use. These smooth cooktop stoves, or "smoothtops" as they are sometimes called, utilize as the heating element separate areas on the top surface of the stove (at the same location that gas stove would have burners) which are made of glass. Under each area, usually circular, is a strong light source, such as a halogen lights. The light source projects the light upward to the surface area of the smoothtop's heating element—the glass area on the top surface of the stove.

Since the glass area is coated on its bottom with a dark coating, when the light strikes it, the heat from the strong light is absorbed by the glass area and these glass surfaces form each heating element of the stove.

Another variation of the smooth cooktop is the use of a "ribbon heating element" where the smooth glass surface is heated by a coiled electric circuit called a "ribbon element" just underneath it instead of by a halogen light source. The heat is transmitted directly upward so that only the heat element itself gets hot and the rest of the cooktop surface remains cool. In some cases, the ribbon heating element also has another feature whereby the heating element is made of two concentric circles so that the option exists of two sizes of the heating element to match the two different sizes of the pans that need to be heated. This new technology does not solve the problem of warning adults and children that the heating element should not be touched when the cooking process has ended. If anything, it generates the additional hazard that someone can be lulled into touching the heating element after thinking the heating element is cool since the surface right adjacent to it is indeed cool.

With respect to toaster ovens, because of its mobility the danger of touching the window of a toaster oven exceeds that of the typical immobile oven. The toaster oven can be placed on a counter top or other portion of the kitchen not directly in the "cooking center". Consequently, an adult and especially a child, or the elderly, is not likely to remember not to touch a window of a toaster oven when it is off (soon after it had been on). In addition, the door of a toaster oven can be left open and jut out further toward someone in the kitchen.

Presently, in order to address the danger of touching a hot "smoothtop" stove, such stoves generally have several light indicators, each one corresponding to each heating element, all located in small one rectangular area on the surface of the cooktop. The light indicators remain lit for a certain length of time after the stove's heating element is turned off in order to deter someone from touching the heating element when it is still hot, although "off". Unfortunately, this attempt to address the danger of touching a hot stove of the smooth cooktop variety is insufficient as a warning system (putting aside the fact that the light indicators are designed only for the smooth cooktop variety stoves to begin with and not for gas and electric coil stoves).

A quick glance at the group of light indicators would not be sufficient to warn the average adult, no less children or the elderly, that a particular heating element is too hot. This is because the group of light indicators do not immediately tell someone which heating elements correspond to which light indicators. At a minimum, several seconds of concentration are needed in order to determine from the light indicators that are "on", which heating elements are too hot to touch. Most adults, and certainly most children, cannot afford those seconds of deduction since their desire to touch the stove is immediate. In addition, an adult carrying groceries into the kitchen and looking for a counter top to place them on or a child running into and playing in the kitchen are even less likely than the average adult or child to take the time to engage in a several second thinking process. Accordingly, the child or the adult will be inadequately warned about the danger of being burned. With this in mind, it is no surprise that a 1997 industrial design exhibit at the Cooper Hewitt (Smithsonian) in New York demonstrated that over 69% of adults can not match the control knob with its corresponding burner (i.e. heating element) on a stove.

There is also not presently known any effective warning method for the vertical surfaces of oven windows, including the windows of wall ovens, regular ovens and toaster ovens. This is particularly important since when the oven is turned off, the oven window remains very hot even though it appears that everything is off.

In addition, while devices that make use of liquid crystal compositions are known to indicate the surface temperature of an appliance, these devices are not designed to warn someone of the danger of touching hot stoves. For example, U.S. Pat. No. 3,827,301 to Parker discloses an apparatus for indicating the temperature of a surface of an appliance. It has a first portion in contact with the appliance surface or connected by copper wires or heat pipes to the appliance surface. It has a second portion, a poor heat conducting member in heat exchanging relationship to the ambient environment, that has bands of liquid crystal material extending away from the first portion thereby creating a temperature gradient extending away from the surface of the appliance.

Devices such as disclosed in Parker that provide temperature determinations are not adequate for instantly warning a child or even an adult that the heating element of a stove is too hot to touch for one thing because quantitative temperature determinations are inadequate to provide the immediate warning that is necessary. Moreover, the device of Parker and other liquid crystal compositions are not specifically suited to be manufactured as part of a stove. In addition, these devices are not suitable as attachments to stoves and certainly not as attachments to a smooth cooktop stove.

Accordingly, there is needed an effective, convenient and easy to manufacture device for warning adults and children instantly when a stove of any kind is too hot to touch. There is also a need for such a device that is both capable of installation on a previously purchased stove of any known type, including cooktops, electric and gas stoves, and one that is also capable of being manufactured as part of the stove by stove manufacturers. The present invention addresses and satisfies all of these needs and provides other advantages.

SUMMARY OF THE INVENTION

In the present invention, liquid crystal compositions that change color and remain at that color when they reach or exceed a certain temperature (referred to generally herein as "liquid crystal compositions"), such as cholesteric liquid crystals or various types of liquid crystal polymers designed to turn color when they reach a certain temperature, and that are shaped in the outline of the word "HOT" are embedded on the top surface of the heating element of stoves so that they glow red and instantly alert anyone, including a child, that the heating element of the stove is too hot to touch even when the stove is "off". In one embodiment, for use on electric stoves, the device is an improved electric coil whose central area contains the liquid crystals. In a second embodiment for use on smooth cooktop stoves, wall ovens and toaster ovens, the liquid crystal display is embedded in the glass areas that form the heating elements of the smooth cooktop stove. As an alternative to the second embodiment, for smooth cooktop stoves, the liquid crystal display is in the shape of a ring surrounding the heating element (and visible when pots are placed on the heating element) which ring may have an interrupted area in the outline of the letters "HOT"). In a third embodiment for gas stoves, the liquid crystals are embedded in a recessed disk mounted on top of the central element of the gas stove's burner. In each embodiment, the liquid crystals stay red as long as the temperature they sense exceeds a certain degree Fahrenheit, such as 115 degrees Fahrenheit, which has been found to be too hot to touch. In a fourth embodiment for use on wall ovens and toaster ovens, the liquid crystal display is embedded in the glass areas that form the heating elements of the smooth cooktop stove.

OBJECTS AND ADVANTAGES

The following important objects and advantages of the present invention are:

(a) to provide a device that instantly warns anyone including a child that the surface of a stove or hot plate or the window of a toaster oven is too hot to touch, (b) to provide a device that instantly displays to anyone the letters "HOT" as a warning on the surface of a stove, (c) to provide a device that instantly provides a warning display to anyone using the letters "HOT" that appears directly on the heating element of the stove surface so that it is clear to anyone what is too hot to touch, (d) to provide a versatile heat warning device that can be used for smooth cooktop stoves having any kind of surface including glass or metal and using any kind of technology including electric heating, electric induction and halogen light heating, or can be used for electric stoves, or for gas stoves, for wall ovens, for toaster ovens, for hot plates or for warming trays, (e) to provide a device for smooth cooktop stoves having any kind of surface including glass or metal and using any kind of heating technology including electric heating, electric induction and halogen light heating that instantly displays to anyone as a warning on the surface of the stove a ring surrounding each heating element of the stove, which ring may contain in an interrupted area of the ring the letters "HOT", the ring and letters turning red at a certain temperature of the heating element, (f) to provide a heat warning device that is easy to manufacture and that can be either installed onto the stove (or other appliance's) heating element or can be manufactured as part of the stove, (g) to provide a heat warning device for stoves that can be calibrated to signal the word "HOT" or in the case of cooktop stoves to light up a ring around the heating element only when a certain temperature, such as 115 degrees Fahrenheit, is reached and that can remain in signaling mode as long as such temperature is exceeded by the appliance surface and (h) to provide a heat warning device as above that makes use of liquid crystals that change color when a certain temperature is reached, such as cholesteric liquid crystals or various types of liquid crystal polymers designed to change color when a certain temperature is reached.

BRIEF DESCRIPTION OF THE DRAWINGS

FIG. 5 is a top plan view of the device of the present invention used on an electric stove.

FIG. 6 is an enlarged fragmentary plan view of one heating element of an electric stove having the device of the present invention.

FIG. 7 is an enlarged fragmentary cross-sectional view taken along line 7—7 of FIG. 6.

FIG. 9A is an enlarged fragmentary plan view of one heating element of a smooth cook top stove and having the device of the present invention in the shape of a ring surrounding the heating element.

FIG. 10A is a enlarged fragmentary cross-sectional view taken along line 10A—10A of FIG. 9A.

FIG. 11 is a front elevational view of a wall stove having the device of the present invention.

FIG. 12 is an enlarged fragmentary front elevational view of one heating element of a smooth cook top stove having the device of the present invention.

FIG. 13 is a enlarged fragmentary cross-sectional view taken along line 13—13 of FIG. 12.

FIG. 14 is a front elevational view of a wall oven having the device of the present invention.

DETAILED DESCRIPTION OF THE DRAWINGS

Figure 1:
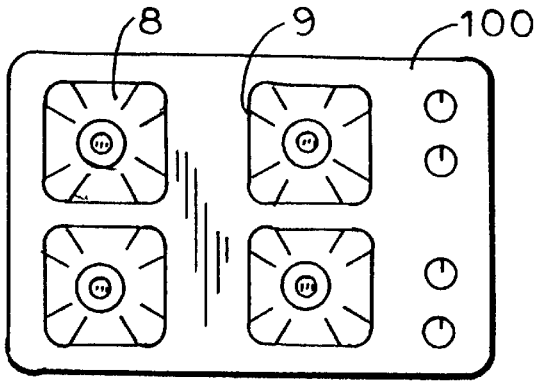
FIG. 1 is a top plan view of a gas stove having the device of the present invention on each burner.
Figure 2:
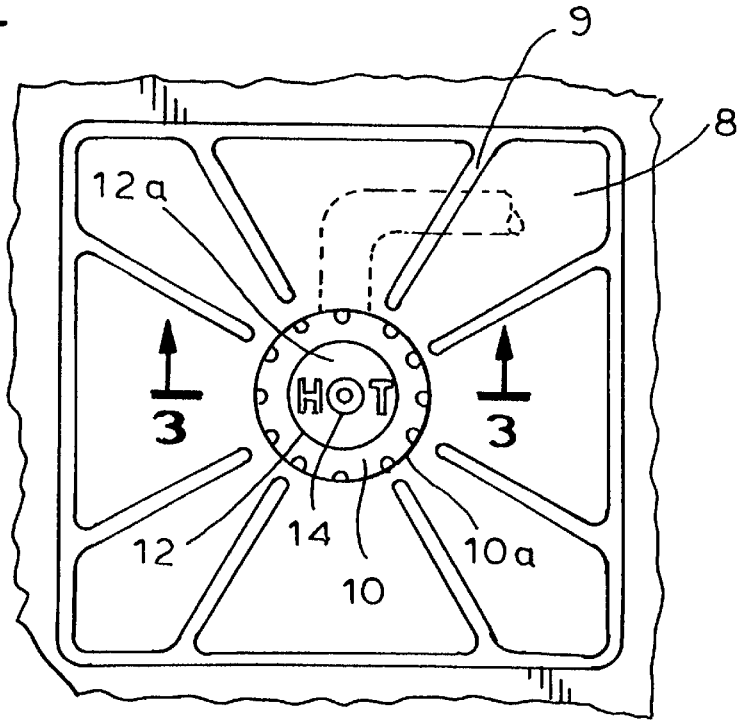
FIG. 2 is an enlarged fragmentary plan view of a heating element of a gas stove having the device of the present invention.
Figure 3:
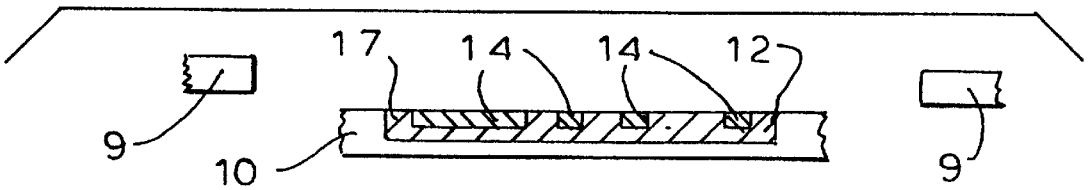
FIG. 3 is an enlarged fragmentary cross-sectional view taken along line 3—3 of FIG. 2.

One of the embodiments of the present invention is for stoves that employ gas heat, as seen in FIGS. 1–3. In this embodiment, the top of the stove 100 typically has four heating elements 7, that are called burners and that are covered by metal grates 9, that are open in the middle. Each burner or heating element is situated in a recessed area 8 and is surrounded by the metal grate. As best seen in FIG. 2, there is a central metal element 10 in which a series of gas inlet holes on the side 10*a* of the central metal element permit gas to flow through and ignite. As seen in FIGS. 1–3, the central metal element 10 has a disk 12 on a top surface 12*a* of the central metal element 10 and this disk 12 contains liquid crystals 14 in the form of the letters "HOT" that change color when they reach a certain temperature. Alternatively, the central metal element 10 itself can have embedded therein on its top surface the liquid crystals 14 in the shape of the letters "HOT" using known methods.

The temperature of the grates upon which pots and pans rest during cooking may be roughly equal to the temperature of the central metal element 10. Accordingly, whenever the letters "HOT" become red both the grates and the central metal element may be too hot to touch. However, there may be some discrepancy between the temperature of the grates and that of the central metal element 10. To take into account any discrepancy between the temperature at which the central element 10 becomes cool and the temperature at which the metal grates become cool enough for safe touch, the turning temperature, as an option, the temperature at which the liquid crystal compositions 14 (such as cholesteric liquid crystals or various types of liquid crystal polymers designed to turn red at a specific temperature) turn red, can be calibrated by lowering the turning temperature by an estimate of the amount of this discrepancy so that if either the grates or the central metal element 10 is too hot the liquid crystals 14 will remain red.

FIGS. 5–7 depict an embodiment of the present invention for the top surface of electric stoves. Electric stoves typically have four heating elements on the top of the stove made of electric coils 20 wound in a serpentine configuration and sitting on a metal rest 21. Normally, electric coils 20 have a recessed disk 22 in a central area of each coil 20 that is connected to and held up by the metal rest 21. FIG. 5 shows top plan view and FIG. 6 shows an enlarged fragmentary plan view of electric coil 20 of the present invention having central disk 22 containing liquid crystal compositions 24 (which may be cholesteric liquid crystals or various types of liquid crystal polymers designed to turn color at a specific temperature) that are in the shape of the letters "HOT" embedded on the top surface 22*a* thereof. The liquid crystals 24 become red whenever the temperature of central disk 22 exceeds 115 degrees Fahrenheit and remains red unless and until this temperature is crossed again. This electric coil 20 may be made by embedding the liquid crystals 24 on the top surface 22*a* of the central disk 22 using methods well known in the art. Alternatively, existing electric coils can be modified by fitting thereon a disk containing on its top surface liquid crystals 24 embedded therein.

The central disk 22 containing liquid crystals 24 in the shape of the letters "HOT" embedded on the top surface 22*a* is recessed roughly a quarter of an inch below the surface of the electric coil 20 so that when pans and pots are placed on the electric coils they do not scratch the central disk 22.

As an option, since there may be some discrepancy between the temperature of the electric coil 20 and that of the central disk 22, the turning temperature at which the liquid crystals 24 turn red, can be set to be the lower of (i) the temperature of the electric coil 20 and (ii) the temperature of the central disk 22. This way, someone is warned against touching either the central element 22 or the actual coil 20.

Figure 4:
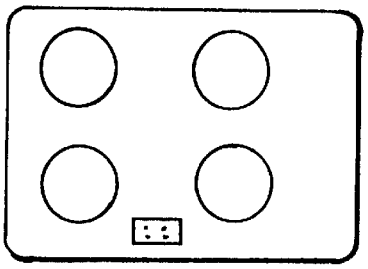
FIG. 4 PRIOR ART
FIG. 4 is the prior art smooth cook top stove showing light indicators.
Figure 8:
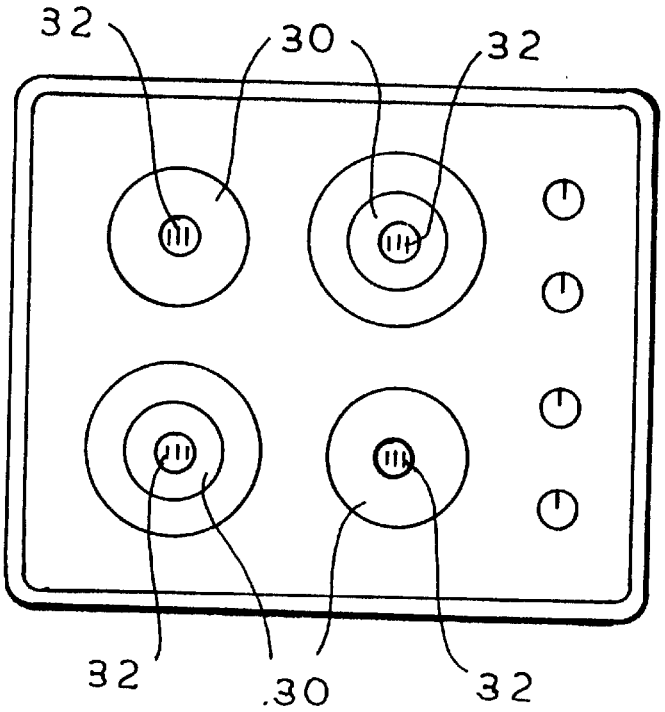
FIG. 8 is a top plan view of the device of the present invention on the smooth surface of a cook top stove.
Figure 9:
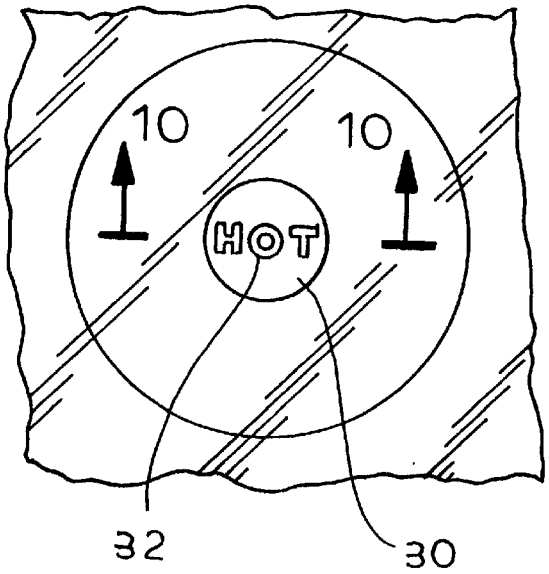
FIG. 9 is an enlarged fragmentary plan view of one heating element of a smooth cook top stove having the device of the present invention.
Figure 10:
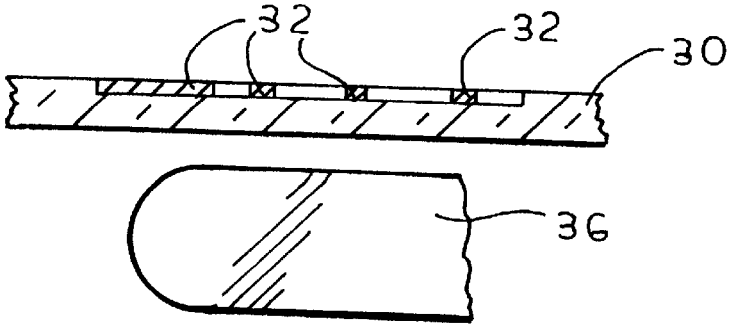
FIG. 10 is a enlarged fragmentary cross-sectional view taken along line 10—10 of FIG. 9.

FIGS. 8–10 depict an embodiment of the present invention for use with smooth cooktop stoves, sometimes called "smoothtops" or "cooktops". For cook top stoves, the prior art is shown in FIG. 4. As seen in FIGS. 8–10, smooth cooktop stoves have heating elements that consist essentially of an area of glass surface 30 that is smooth on top and whose underside is made dark enough to absorb light. Such absorption generates heat in the smooth area of glass 30. Underneath each area 30, usually circular, is a strong light source 36, such as a halogen lights. The light source 36, as seen in FIG. 10, projects the light upward to the surface area of the smoothtop's heating element—the glass area 30 on the top surface of the stove. Since each glass area is coated on its bottom with a dark coating, when the light strikes it, the heat from the strong light is absorbed by the darkened portion of the smooth area of glass 30. These glass surfaces 30 form the heating elements of the stove. For cooking, cooking utensils are simply placed over the area (which may be square, round, etc.) of the heating element on the glass surface. Some smooth cooktop stoves employ "radiant" heat sources for the glass areas instead of halogen light sources 36 but the effect is the same. In addition, some smooth cooktop stoves have halogen lamps (under each area 30 as before) but they emit infrared waves that provide light and heat.

The heat alert device of the present invention when used for the smooth surface of cooktop stoves of either type would comprise liquid crystal composition 32 embedded in the top surface of each glass area 30, which is the heating element on the smooth cooktop stove using known methods. For example, the liquid crystal composition 32 may be made in the exact shape of the letters "HOT" by spraying the composition of liquid crystals 32 over each glass area 30 after covering the glass area 30 with a cardboard stencil or other cut-out in the outline or shape of the letters "HOT". As before, the liquid crystal composition is designed to turn red and remain red whenever the temperature of the smooth area of glass exceeds a specified temperature, such as 115 degrees Fahrenheit.

As an alternative to the second embodiment, for smooth cooktop stoves using any technology including electric heating, electric induction and halogen light heating, the liquid crystal display is in the shape of a ring surrounding the heating element (and visible when pots are placed on the heating element) which ring may have an interrupted area in the outline of the letters "HOT", as seen in FIGS. 9A and 10A. This addresses and solves the problem that people often leave pots or kettles on the stove perpetually and that with cooktop stoves the result of doing so is that the heating element is no never visible (since the pot or kettle may be as large or large than the heating element). In such situations, no matter how mature, cautious and alert you are, you cannot readily ascertain that the heating element (and the kettle or pot above it) is too hot to touch. By seeing the ring of the present invention (with or without the letters "HOT" filling an interrupted portion thereof) lit up as red, you immediately know that the area of the heating element is too hot to touch. In this embodiment, the liquid crystal composition 32 is embedded on the stove surface in the outline of a ring (and in the letters "HOT") in a location of surrounding the heating element, i.e. surrounding the top surface of the smooth glass or metal areas 30 on the stove surface 31.

Although FIGS. 8–10 (including FIGS. 9A, 10A) have been described in terms of smoothtops with heating elements made of smooth glass surfaces, other variations of smooth top stoves exist—in particular smooth metal tops called electric cooktops. The difference is that a light source 36 would not be used under the surface to generate heat—instead the metal gets hot by being connected to a heat source that may be electric (not shown). In addition, some smooth cooktops use a "ribbon heating element" instead of halogen light sources where the smooth glass surface is heated by a coiled electric circuit called a "ribbon element" directly and immediately underneath the glass instead of by a halogen light source. The device of the present invention works the same way for metal cooktops, glass cooktops and for those that rely on halogen light source as the heat or those that use ribbon heating elements. FIGS. 8–9 which depicts the present invention for use with glass cooktops also depicts the present invention as applied to smooth metal cooktop stoves and as applied to ribbon heating elements. FIG. 10, which describes the present invention for use with glass cooktops that employ halogen light sources, the top part of FIG. 10 also depicts a cross section of the liquid crystal composition for smoothtops—for metal cooktops and glass cooktops using ribbon heating elements the halogen light source 36 would not be present but everything else would be the same. For all of the smooth cooktops, the liquid crystal composition 32 would still be embedded in the top surface of the smooth metal areas 30 on the stove surface in the shape of the letters "HOT".

Other variations of smooth cooktops also exist and the liquid crystal composition in the shape of the letters "HOT" can also be embedded in their surfaces. For example, some smooth cooktops have a raised solid element having a smooth top and made of metal having a recessed central area. The liquid crystal composition would be embedded in this recessed central area as before in the shape of the letters "HOT". [add a figure to show this]

FIGS. 11–13 depict a wall oven whose window surface 40 has embedded thereon the liquid crystal composition 46 of the present invention in the shape of the letters "HOT". As before, the liquid crystal composition 46 is designed to turn red and remain red whenever the temperature of the smooth area of glass exceeds a specified temperature, such as 115 degrees Fahrenheit. The purpose is to warn children or adults not to touch the surface of the window 40 that gets very hot when the oven is on. There is not present a convenient and effective warning method in use for the vertical surfaces of oven windows. This is particularly important since when the oven is turned off, the window 40 remains hot even though it appears that everything is off.

Toaster ovens also have a window surface 40 which would have embedded thereon the liquid crystal composition 46 of the present invention in the shape of the letters "HOT". As before, the liquid crystal composition 46 is designed to turn red and remain red whenever the temperature of the smooth area of glass exceeds a specified temperature, such as 115 degrees Fahrenheit.

Hot plates can be thought of as small mobile electric stoves having one heating element. Warming trays can be thought of as small mobile smooth cooktop ovens having one smooth surface as a heating element. In both of these cases, the hot plate and the warming tray, the present invention would be applied to the heating element and function the same way as described with respect to their larger and more permanent counterparts—the electric stove and the cooktop stove.

It should be noted in general that the present invention makes use of any liquid crystal composition that changes color and remains at that color when a specified temperature is reached or exceeded—it need not necessarily be cholesteric, although it has been found that cholesteric liquid crystals do this effectively. It is also within the scope of the present invention to make use of a liquid crystal composition that changed color when it reached a specified temperature or temperature range but changed to a third color at a higher threshold temperature, so long as the third color is significantly different from the first color—although this would certainly not be the ideal kind of liquid crystal composition. The ideal composition turns red at a specified temperature and remains red above that temperature.

With use of the present invention, when an individual enters the kitchen with the cook top stove in it he or she can instantly recognize if any of the heating elements are too hot. This is in contrast to the prior art for which the person would have to first figure out which heating element corresponds to which light indicator.

The present invention contemplates that other letters and other letter shapes besides that of "HOT" could be used as a warning although it is believed that the simple arrangement of the letters "HOT" in the simplest typeset provide the best warning. Furthermore, the present invention also contemplates that the liquid crystal composition in the outline of the letters "HOT" can be embedded in a surface of a stove, toaster oven or other appliance where the surface is vertical and perpendicular to the floor, not only horizontal. In addition, while the drawings depict the liquid crystal composition embedded on the surface of the stove in a particular configuration and depth, it is contemplated by the present invention that the depth and configuration of the liquid crystal composition can vary and still be within the scope of this invention.

It is also contemplated by the present invention that glass disks containing liquid crystal compositions in the shape of the letters "HOT" can be made so as to be purchased separately by the consumer as a glass disk having embedded therein the liquid crystal composition to be affixed to a glass surface area of a cooktop stove, a wall oven or a toaster oven.

In general, it is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof. It is not desired to limit the invention to the exact construction and operation shown and described. The spirit and scope of this invention are limited only by the spirit and scope of the following claims.

What is claimed is:

1. An improvement in a heating element for a top surface of an electric stove made of an electric coil, the improvement comprising:

an insulated serpentine electric coil centered around a central disk having a liquid crystal composition in the shape of the letters "HOT" embedded on a top surface of the disk, said liquid crystal composition designed to turn red and remain red whenever the disk exceeds a specified temperature.

2. The improvement of claim 1, wherein the liquid crystal composition is designed to turn red and remain red whenever the disk exceeds 115 degrees Fahrenheit.

3. An improvement in a heating element for a top surface of a gas stove of the type having heating elements situated in recessed area and surrounded by metal grates, the improvement comprising:

a central metal element 10 having a series of gas inlet holes on its side and having a disk on a top surface of said central metal element containing liquid crystals in the form of the letters "HOT" embedded on the disk, said liquid crystal composition designed to turn red and remain red whenever the disk exceeds a specified temperature.

4. The improvement of claim 3, wherein the liquid crystal composition is designed to turn red and remain red whenever the disk exceeds 115 degrees Fahrenheit.

* * * * *